US006053471A

United States Patent [19]

Brown

[11] Patent Number: 6,053,471

[45] Date of Patent: Apr. 25, 2000

[54] CONVERTIBLE, TILT-BRACKET ASSEMBLY FOR MOUNTING TROLLING MOTORS

[76] Inventor: Edward D. Brown, 827 S. Highway 7, Pittsburgh, Kans. 66762-7225

[21] Appl. No.: 09/124,524

[22] Filed: Jul. 29, 1998

Related U.S. Application Data

[60] Provisional application No. 60/054,139, Jul. 29, 1997.

[51] Int. Cl.[7] ..... F16M 1/00

[52] U.S. Cl. ..... 248/642; 248/640; 248/643; 440/53

[58] Field of Search ..... 248/640, 642, 248/643, 548, 900; 440/6, 53

[56] References Cited

U.S. PATENT DOCUMENTS

| | | | |
|---|---|---|---|
| Re. 30,567 | 4/1981 | Meredith et al. | 248/642 |
| 2,478,858 | 8/1949 | Buske | 440/6 |
| 2,782,744 | 2/1957 | Staley . | |
| 2,921,182 | 1/1960 | Taylor . | |
| 2,928,631 | 3/1960 | Hartman . | |
| 3,240,453 | 3/1966 | Kiekhaefer . | |
| 3,246,915 | 4/1966 | Alexander, Jr. . | |
| 3,604,674 | 9/1971 | Wilkerson | 248/642 |
| 4,285,485 | 8/1981 | Burke | 248/291 |
| 4,363,629 | 12/1982 | Hall et al. | 248/642 |
| 4,367,860 | 1/1983 | Strang | 248/642 |
| 4,410,161 | 10/1983 | Booty | 248/642 |
| 4,667,915 | 5/1987 | Boucher et al. | 248/293 |
| 4,819,905 | 4/1989 | McCain | 248/642 |
| 5,005,798 | 4/1991 | McCoy | 248/642 |
| 5,026,308 | 6/1991 | Sumigawa | 248/640 |
| 5,112,258 | 5/1992 | Folsom | 440/6 |
| 5,116,267 | 5/1992 | Olson | 248/642 |
| 5,151,058 | 9/1992 | Tahara et al. | 248/642 |
| 5,169,350 | 12/1992 | Tsujii | 248/642 |

*Primary Examiner*—Anita M. King
*Assistant Examiner*—Debbie Short
*Attorney, Agent, or Firm*—Richard C. Litman

[57] ABSTRACT

A mounting bracket assembly comprising two separable main components, a tilt bracket and a swivel plate, which assembly 1) is convertible for use with any one of various types of trolling motors adapted for bow or transom mounting; 2) convertibly mounts to a bow gunwale, transom or deck of any of a variety of small fishing boats; and 3) has a tilt-mechanism which minimizes the damaging effect of an underwater impact to a trolling motor of either mounting type. comprise the assembly. The tilt bracket includes a clamp portion for securing the assembly to a bow gunwale or transom, and a tilt table portion including a top plate, an energy-absorbing assembly having ends operably attached between the top plate and the clamp portion, and a pivot mechanism positioned outboard of the gunwale about which the top plate pivots. This assembly allows pivotal movement of the motor about the pivot mechanism in a vertical plane when impact occurs with an underwater object to minimize damage to the motor. The swivel plate includes a cross bar perpendicularly and transversely the swivel plate which extends outboard and serves as a false transom for mounting a trolling motor having clamping arms onto any position about the boat, and adapts trolling motors not having clamping arms for use with the tilt bracket. The top plate includes a swivel mechanism providing the swivel plate with the functional advantage of being able to rotate in a horizontal plane.

17 Claims, 15 Drawing Sheets

CONVERTIBLE, TILT-BRACKET ASSEMBLY FOR MOUNTING TROLLING MOTORS

CROSS-REFERENCE TO RELATED APPLICATION

This application claims the benefit of U.S. Provisional Patent Application Ser. No. 60/054,139, filed Jul. 29, 1997.

BACKGROUND OF THE INVENTION

1. Field of the Invention

The present invention relates generally to mounting brackets for use with trolling motors on fishing boats. More specifically, the invention relates to a mounting bracket assembly, having a tilt-mechanism and a swivel plate, which is convertible for use with any one of various models of trolling motors and which mounts to bow gunwale or deck of any of a variety of small fishing boats, the tilt-mechanism minimizing the damaging effect of an underwater impact to the trolling motor.

2. Description of Related Art

Recent trends in recreational fishing and watersport activities show an increased popularity and use of trolling motors to power and navigate both single and double hulled boats. Trolling motors are smaller and lighter than conventional outboard motors and allow the boater to access areas of a body of water not otherwise possible with the standard outboard motor. Moreover, trolling motors are environmentally more sensitive than conventional outboard motors, powered on electricity and travelling quietly and odorlessly at about 3 to 4 mph. Hence, a wide variety of trolling motor models exist, most typically, being stern, transom mounted by a mounting bracket, and either operated by a tiller or foot-operated controller attached to a motor housing from which an elongated propeller shaft operably extends.

Unfortunately, the conventional mounting brackets are limited in design for conventional transom mounting, and allow only fore and aft pivoting of the motor housing and shaft, from a generally horizontal stored position to an angular or vertical and rigid position for raising and lowering the propeller to a preset depth. Therefore, in the down position, striking an underwater obstruction is likely to cause damage to the shaft or propeller assembly by virtue of the rigidly fixed relationship between the motor housing and the mounting bracket during the motor's operation. Moreover, in the stored position, the elongated shaft and motor housing interfere with onboard preparation for embarking or disembarking, often requiring the boater to step over the shaft thereby further risking injury to both the boater and the shaft by a trip and fall onto the trolling motor.

In addition to problems presented by conventional stern mounted trolling motors, conventional means when attached to the bow of the boat present even more problems. A bow mounted trolling motor is desired to improve steerability, the motor pulling the boat forward rather than pushing from behind. This feature is particularly desirable when fishing in shallow water or confined coves. However, whereas boats almost universally provide a transom uniformly designed to accept motor brackets, the bows of boats differ dramatically. For example, a simple V-shaped bow allows a conventional bracket to mount to the bow gunwale and allow the motor to be operated normally; however, during storage, the shaft of the motor extends diagonally across and extending beyond the beam of the boat, requiring its removal from the gunwale, particularly during trailering. In an alternative example, other small boats are decked at the gunwale, such as some pontoon boats, thereby preventing attachment of the transom-type mounting bracket at the bow. Similar mounting problems arise from boats with oddly shaped gunwales or bows.

There is, therefore, a need of a mounting bracket that easily and universally mounts to the bow of any one of a large variety of boats, that permits attachment of any one of a variety of trolling motors, that has means to rotate the motor horizontally during transport or storage, and that has means permitting angular deflection of the propeller and shaft rearward when either encounters an underwater obstacle. The present invention provides such a convertible tilt-bracket.

Impact energy absorbing mounting brackets have been described in the patent literature. For example and most notably, U.S. Pat. No. Re. 30,567 reissued Apr. 7, 1981 to Meredith et al. describes a trolling motor safety mount including a hollow mounting block pivotally mounted to a clamp with a detent arrangement which maintains the block and motor in an operative position. This simple arrangement is limited to fore and aft angular movement of the motor solely for the purpose of deflecting when striking an underwater object.

Various transom-mounted versions of such brackets have been developed for use in combination with outboard motors. U.S. Pat. No. 3,240,453 issued Mar. 15, 1966 to Kiekhaefer describes an outboard motor with an energy absorbing mounting bracket including a rack and pinion assembly tied to a clutch assembly. U.S. Pat. No. 3,246,915 issued Apr. 19, 1966 to Alexander, Jr. describes a tilting clamping assembly employing a dampening hydraulic shock absorber or spring. However, these members have the objective of preventing damage to the transom or motor due to shocks absorbed, not due to an impact with an underwater obstacle, but rather due impact with one another after tilting at high-speed passage over an underwater object. Such mechanisms are dissimilar in structure and function from the present invention intended for slow-speed trolling motors.

Tiltable and pivotable bracket assemblies have been applied for numerous other objects, and their structures have been modified accordingly. U.S. Pat. No. 2,782,744 issued Feb. 26, 1957 to Staley describes an apparatus for transom mounting an outboard motor behind a boat for optimizing propeller draft. U.S. Pat. No. 2,928,631 issued Mar. 15, 1960 to Hartman describes a crank-operated supporting assembly for swingably lifting heavy outboard motors mounted on the transoms of cabin cruisers. U.S. Pat. No. 2,921,182 issued Jan. 12, 1960 to Taylor describes a bracket which self-adjusts the headlight of a boat. U.S. Pat. No. 4,285,485 issued Aug. 25, 1981 to Burke describes a retractable sonar sensor system employing a rod and spring-loaded disc assembly to rotate the rod from a vertical to a horizontal orientation. U.S. Pat. No. 4,667,915 issued May 26, 1987 to Boucher et al. describes a marine sensor mounting mechanism including a bifurcated bracket for permanent attachment to a hull, wherein a toggle link allows a sensor mounted in an operative position of the bracket when struck to move out of the way of the underwater object to an inoperative position.

Nevertheless, all of the above described mounting brackets fail to disclose a tilt-bracket and swivel plate assembly providing a convertible means for absorbing underwater impacts, convertible for use with any one of various trolling motors or boat bows, with the added advantage of permitting the motor to rotate in a substantially horizontal plane during storage or transport. None of the above inventions and patents, taken either singly or in combination, is seen to describe the instant invention as claimed.

SUMMARY OF THE INVENTION

The present invention is a mounting bracket assembly having a tilt-mechanism and a swivel plate, which assembly 1) is convertible for use with any one of various types of trolling motors adapted for bow or transom mounting; 2) convertibly mounts to a bow gunwale, transom or deck of any of a variety of small fishing boats; and 3) has a tilt-mechanism which minimizes the damaging effect of an underwater impact to a trolling motor of either mounting type. Several embodiments of the assembly are described herein, each including common components, namely two separable components, a tilt bracket and a swivel plate.

The tilt bracket includes a clamp portion dimensioned and configured to rest on a bow gunwale or, as traditionally used, the transom of a fishing boat, the clamp portion including conventional clamping means for securing the tilt bracket to the bow gunwale or transom. The tilt bracket further includes a tilt table portion including a top plate, an energy-absorbing assembly having ends operably attached between the top plate and the clamp portion, and a pivot mechanism positioned outboard of the gunwale about which the top plate pivots. This assembly allows for pivotal movement of the motor about the pivot mechanism from a vertical plane when impact occurs with an underwater object to minimize damage to the motor. The tilt bracket is also provided with a locking pin which passes through the clamp portion and a tang depending from the tilt-table portion to disable the pivotal movement, as may be desirable during certain emergency circumstances.

The swivel plate includes a cross bar perpendicularly and transversely attached to a first end portion of the swivel plate which extends outboard of the boat when the assembly is mounted. The cross bar serves as a false transom for mounting a typical trolling motor having clamping arms onto any position about the boat, and adapts trolling motors not having clamping arms for use with the tilt bracket. The top plate includes a swivel mechanism providing the swivel plate with the functional advantage of being able to rotate in a horizontal plane.

Accordingly, it is a principal object of the invention to provide a device for mounting a plurality of types of trolling motors to a plurality of types of boat designs.

It is another object of the invention to provide a tilt-mechanism with a pivotable top plate to dampen any forces experienced when the motor strikes an underwater object.

It is a further object of the invention to provide a mounting bracket assembly capable of attaching transom-mounting trolling motors to the bow of a fishing boat.

Still another object of the invention is to provide a swivel plate which is convertible to support various trolling motor mounting assemblies.

Yet another object of the invention is to provide a swivel plate permitting horizontal rotation while a trolling motor is either in a stored or operational mode.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates generally to mounting brackets for use with trolling motors on fishing boats. More specifically, the invention relates to a mounting bracket assembly, having a tilt-mechanism and a swivel plate, which assembly 1) is convertible for use with any one of various types of trolling motors adapted for bow or transom mounting; 2) mounts to a bow gunwale, transom or deck of any of a variety of small fishing boats; and 3) has a tilt-mechanism which minimizes the damaging effect of an underwater impact to a trolling motor of either mounting type.

Figure 1:
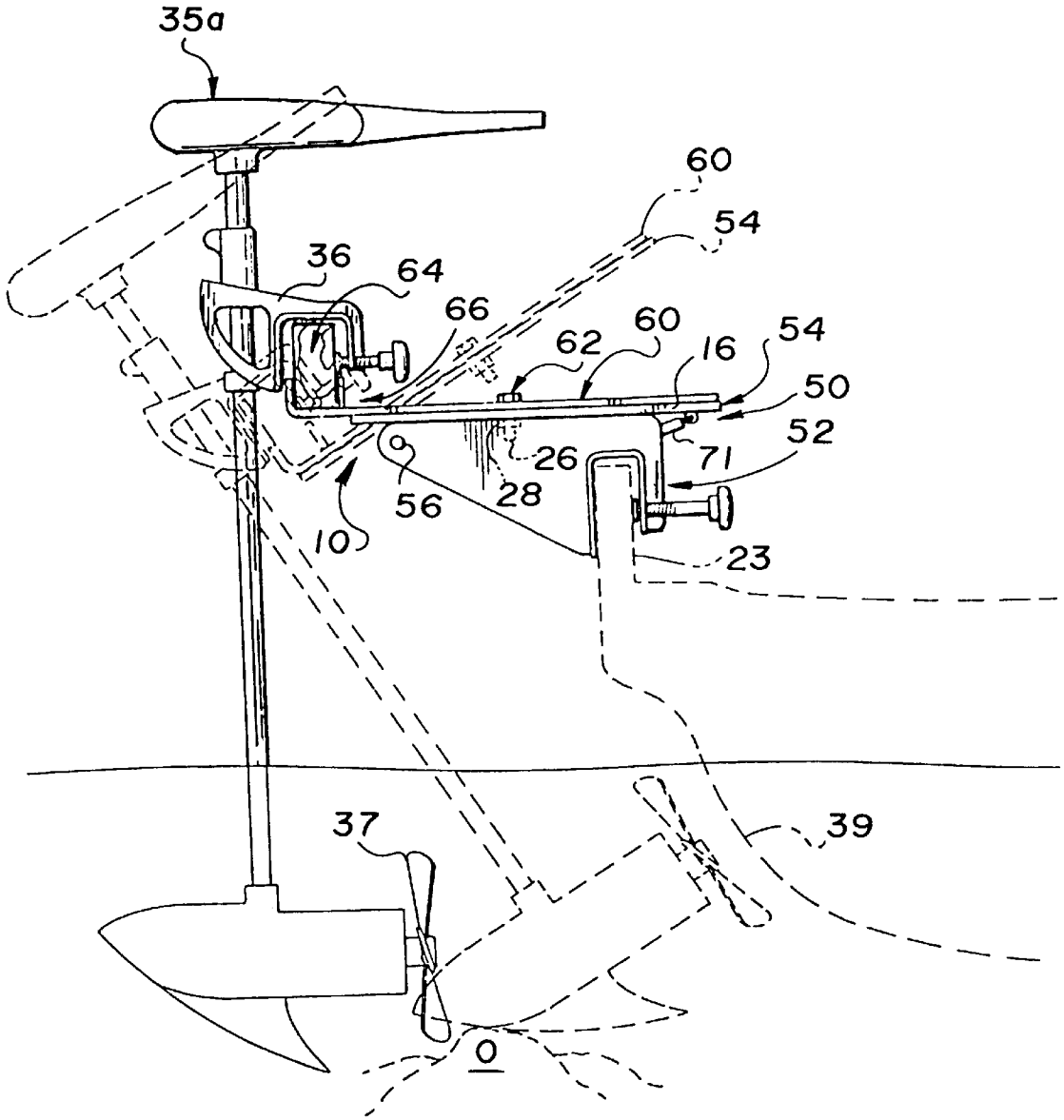
FIG. 1 is environmental, elevational view of a first embodiment of the mounting bracket assembly in a first convertible state of attachment to a boat gunwale. Two functional states are also shown, an operative state, shown in broken lines, and a resting state, shown in solid lines, respectively representing the position of the trolling motor in a normal operational mode and during impact with an underwater obstacle.
Figure 6:
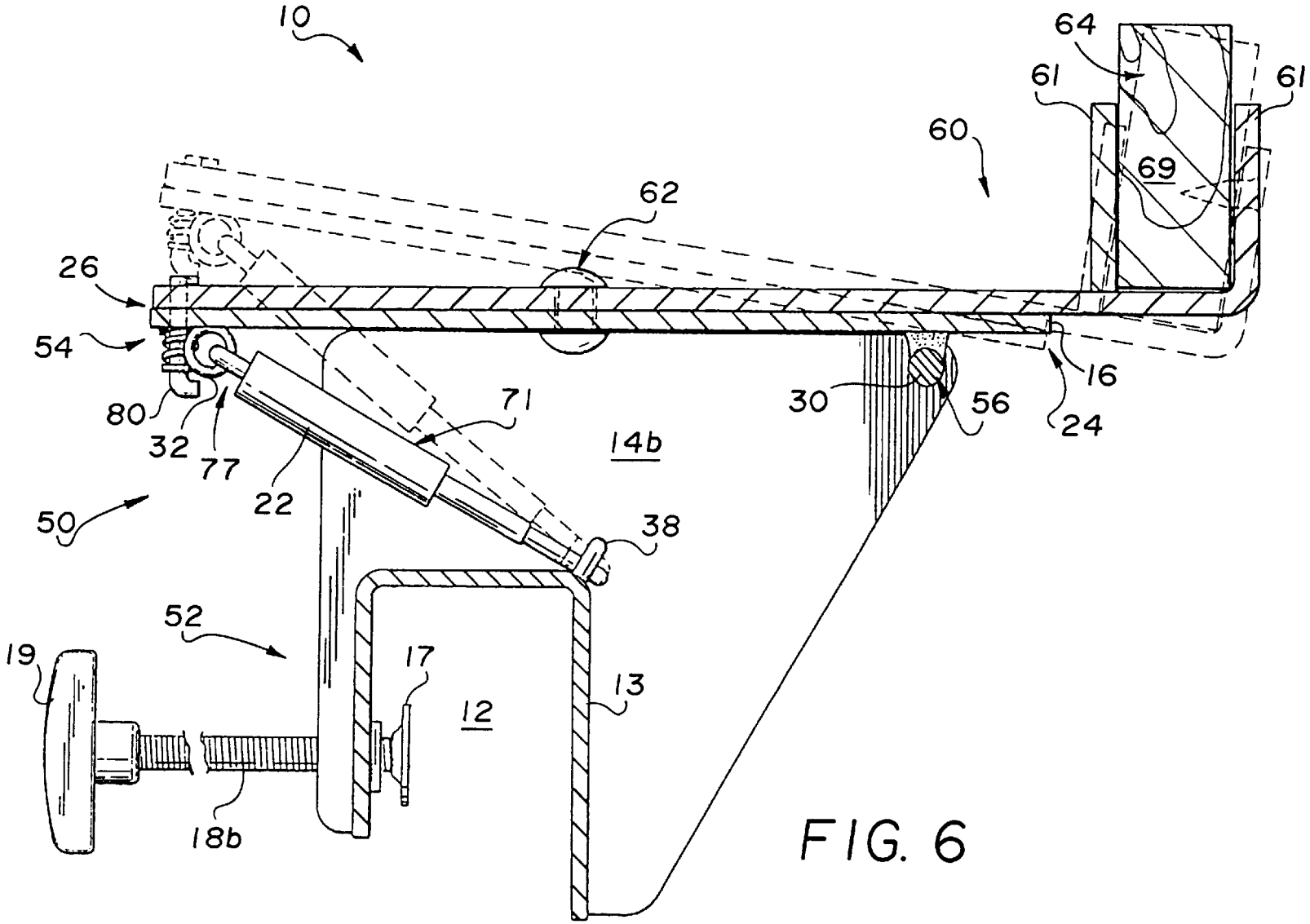
FIG. 6 is a right side sectional view of a complete mounting bracket assembly, showing a third embodiment of the tilt bracket in combination with a swivel plate.

The major components of the present invention are described generally while referring to FIGS. 1 and 6, each Figure showing a different embodiment of a mounting bracket assembly 10. Each embodiment includes common components, namely two separable components, a tilt bracket 50 and a swivel plate 60. The tilt bracket 50 includes a clamp portion 52 dimensioned and configured to rest on a bow gunwale 23 or, as traditionally used, the transom of a fishing boat 11, the clamp portion 52 including conventional clamping means for securing the tilt bracket 50 to the bow gunwale or transom. The tilt bracket 50 further includes a tilt table portion 54 including a top plate 16, an energy-absorbing assembly 71 having ends operably attached between the top plate 16 and the clamp portion 52, and a pivot mechanism 56 positioned outboard of the gunwale 23 about which the top plate 16 pivots. The specific features of the present invention 10 will be first discussed below with respect to the various states into which the assembly can be converted for use with a multiplicity of models of trolling motors and boat designs, and then with respect to the energy-absorbing function of the tilt-mechanism alone.

FIG. 1 shows the tilt bracket 50 clamped to the bow gunwale 23 of a boat, to which the swivel plate 60 is securely attached. The swivel plate 60 includes a cross bar 64 perpendicularly and transversely attached to a first end portion 66 of the swivel plate 60. In a first embodiment and momentarily referring to FIG. 6, the cross bar 64 comprises a 2×4 or 2×6 piece of lumber 69, attached between an integral pair of flanges 61 perpendicularly depending from first end portion 66. The cross bar 64 serves as a false transom for mounting a typical trolling motor 35A, the motor 35A having clamping arms 36 shown clamped onto the cross bar 64. In the preferred embodiment and as suggested by the rectangular piece 104 of FIG. 14, the cross bar 64 may be formed to the same shape and of the same material as the swivel plate, and be integrally attached to the swivel plate 60, such as by welding when the material is a metal.

Figure 8:
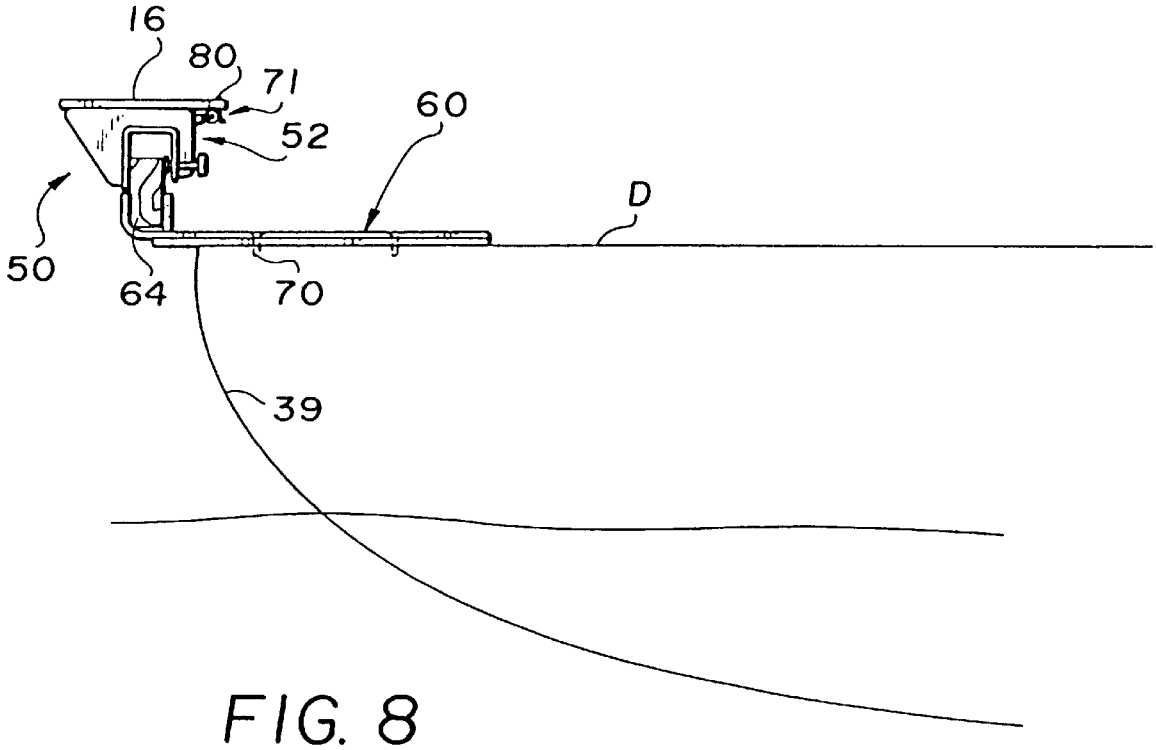
FIG. 8 is an environmental, elevational view of the preferred embodiment of the mounting bracket assembly representing a third convertible state of attachment, the swivel plate in an affixed state attached directly to the boat foredeck for use as a false transom-type mount for the tilt bracket.
Figure 9:
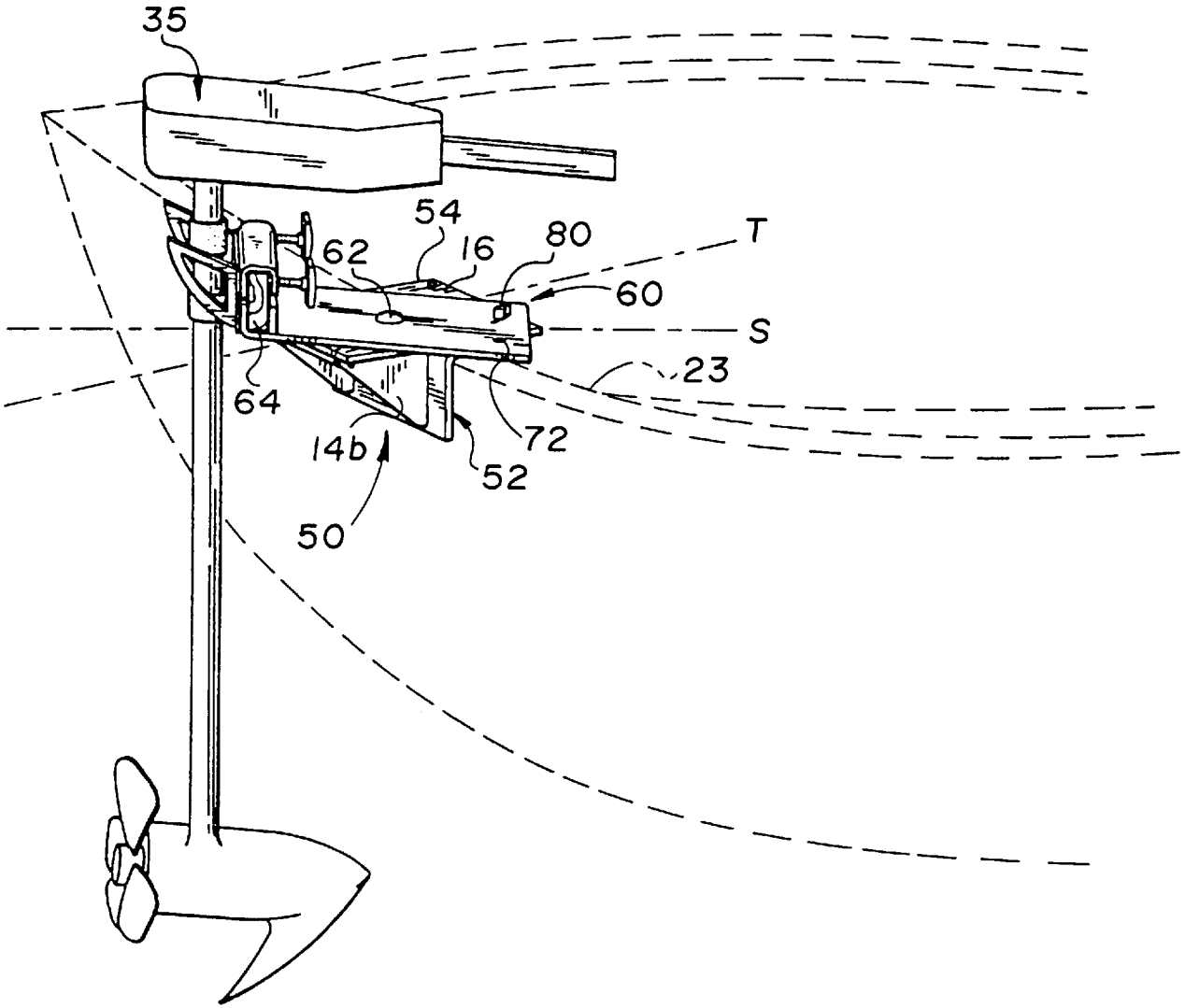
FIG. 9 is an environmental, perspective view of the preferred embodiment of the mounting bracket assembly representing the swivel plate secured in a skewed position while the trolling motor is in an operational mode, the mounting bracket assembly attached in a first convertible state to a V-shaped bow.

The top plate 16 also includes a swivel mechanism 62 providing the swivel plate 60 with two functional features, as can be best appreciated from FIGS. 6 and 9. First, the swivel mechanism 62 rotatably attaches the swivel plate 60 to the top plate 16, which permits selective rotation of the swivel plate 60 in a horizontal plane to bring the swivel plate 60 into a skewed position relative to the top plate 16, and thus provides a multitude of advantageous uses described later. Second, the swivel mechanism 62 removably attaches the swivel plate 60 to the top plate 16, thereby allowing selective repositioning of the swivel plate 60 to convert the assembly 10 into one of three states of attachment to a boat: a first convertible state (FIG. 1), a second convertible state (FIG. 7), and a third convertible state (FIG. 8).

FIG. 1 illustrates a simple embodiment of a removable swivel mechanism 62, namely a threaded bolt 26 passed through a hole 21 (seen in FIG. 2) centrally defined in the top plate 16 and a matingly threaded nut 28 securing the bolt 26 below the top plate 16. Obviously, a more elaborate assembly known to an individual skilled in the art of swivel mechanisms can be used, including reduced friction bearings, devices having bushings, and the like.

The first convertible state, illustrated in FIG. 1, disposes the swivel plate 60 with the cross bar 64 oriented upward relative to the top plate 16. This preferred state is useful for mounting most trolling motors (i.e. those having clamping arms 36) to any boat having a bow gunwale 23 dimensioned to receive a conventional trolling motor clamping arm 36. The trolling motor 35A is thus positioned further outboard of a gunwale 23, which when mounted on the bow of a boat, allows the intended operation of the tilt table portion 54 by providing clearance between the propeller 37 and the boat hull 39.

By providing such clearance, two functional states of the tilt table portion 54 result: a resting state, shown in solid lines, and an operative state, shown in broken lines, each respectively representing the position of the trolling motor 35A in a normal operational mode and during impact with an underwater obstacle O. As suggested by the phantom lines in FIG. 1, the top plate 16 pivots about the pivot mechanism 56 when the trolling motor contacts the underwater obstacle. As will be later discussed in more detail with reference to FIG. 4 and FIG. 6, the energy-absorbing assembly 71 (shown only in solid lines in FIG. 1), reacts to the impact force by expanding, allowing reactive and unhampered movement of the top plate 16 about the pivot mechanism 56. Moreover, the energy-absorbing assembly 71 serves to restrain the top plate 16 from undesired bouncing of the tilt table mechanism 54 in the resting state during normal operating conditions of the motor; however, during impact, the energy-absorbing assembly 71 minimizes impact forces by absorbing energy during expansion.

Figure 7:
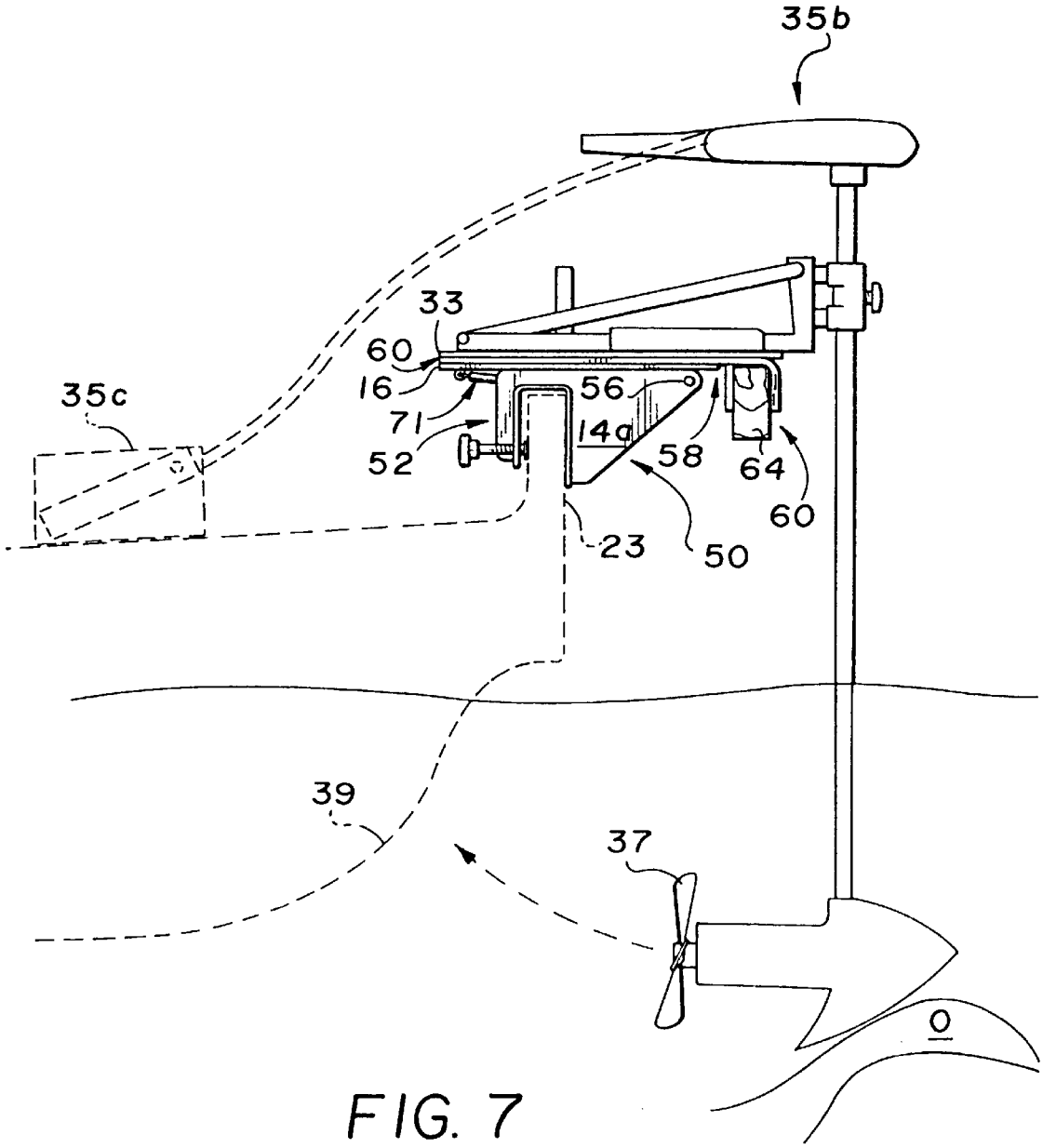
FIG. 7 is an environmental, elevational view of the preferred embodiment of the mounting bracket assembly representing a second convertible state of attachment to a boat having the swivel plate in a stored condition, the trolling motor shown mounted to the tilt bracket and in a normal operational mode prior to impact with an underwater obstacle.

In contrast to FIG. 1, FIG. 7 illustrates a second convertible state of attachment, wherein the swivel plate 60 is in a stored condition attached between a motor mounting plate 33, provided with a trolling motor 35B, and the top plate 16. This stored condition permits various different models of trolling motors, 35B and 35C, (i.e. those not having clamping arms 36) to be mounted to the tilt bracket 50 of the present invention to take advantage of the operative state of the tilt table portion 54 during impact of the motor with an underwater obstacle O. Two particular models of trolling motors are shown, namely a foot-operated model 35C (such as the MINN-KOTA Bow Mount-Foot Control Turbo Model 565Ta), and a hand-operated model 35B (such as the MINN-KOTA Bow Mount Hand Control Model 324 Turbo Pro a).

As shown, the stored condition orients the cross bar 64 downward relative to the top plate 16. To achieve this orientation, the swivel plate 60 must be dimensioned in length and positioned relative to the swivel mechanism 62 to extend beyond the top plate 16 and permit the first end portion 66 to overhang the top plate 16. Moreover, the amount of overhang from the cross bar 64 to the clamp portion 52 defines a space 58 proximate the pivot mechanism 56. This space 58 should be gauged to position the cross bar 64 relatively close the pivot mechanism 56 and thereby allow the cross bar 64 to act as a stop when it comes into contact with the clamp portion 52 nearest the pivot mechanism 56. The stop thereby limits the inboard angular movement of the propeller 37 towards the hull 39 and prevents a resultant collision therewith.

Turning now to FIG. 8, the third convertible state of attachment is shown, wherein the swivel plate 60 is removed from the top plate 16, the swivel plate 60 being directly mounted to the foredeck D of a boat having no bow gunwales. This arrangement allows the cross bar 64 of the swivel plate 60 to be affixed in an upright orientation and serve as a false transom-type mount for the tilt bracket 50. The fasteners 66 for affixing the swivel plate 60 to the foredeck D may include any of a number of attachment means, including stainless steel screws 70 closely passing through one of a plurality of apertures 72 (best seen in FIG. 9) defined in the swivel plate 60.

Figure 2:
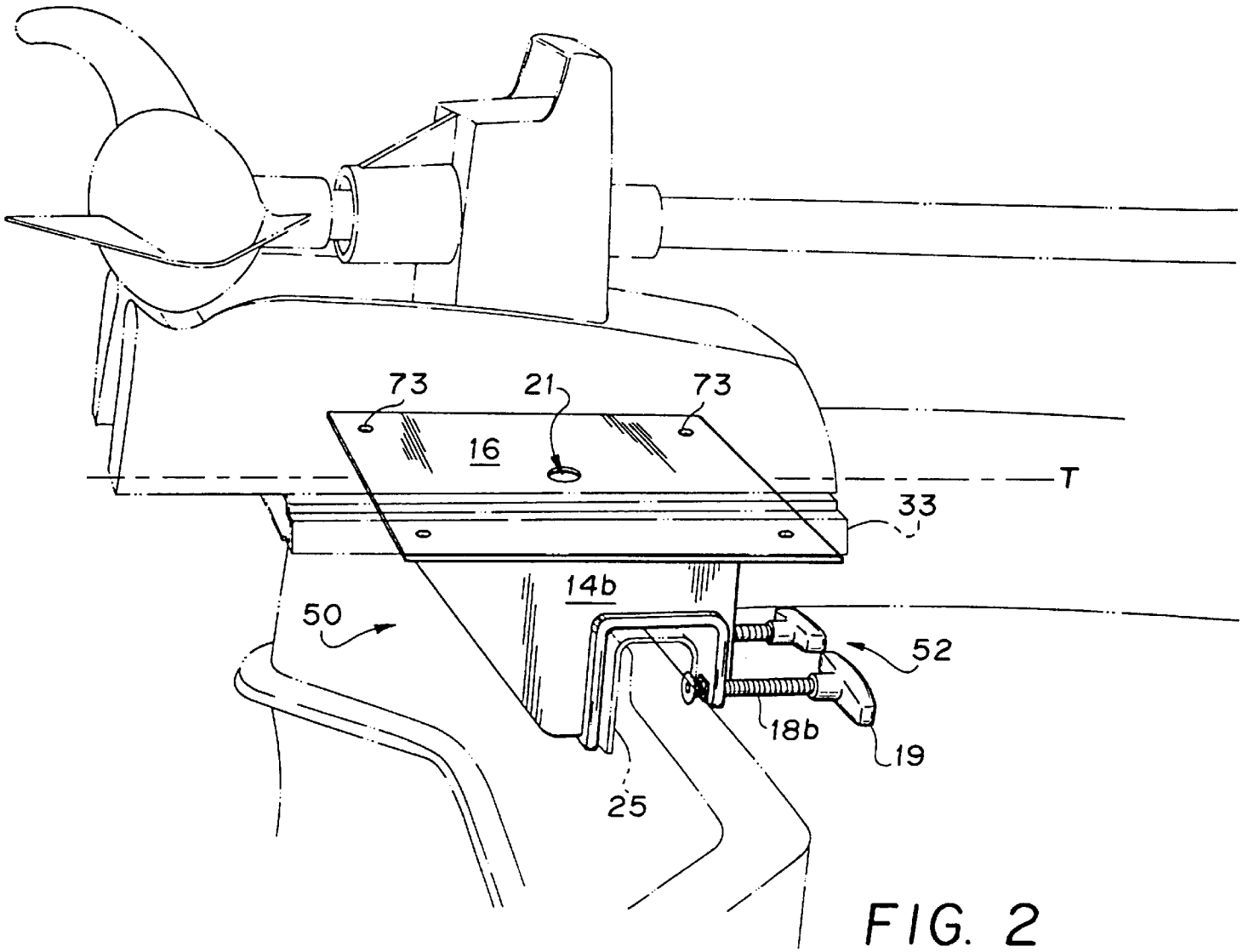
FIG. 2 is perspective view of the tilt bracket of the mounting bracket assembly, shown in use with a trolling motor in a stored mode.

The apertures 72 have an alternative function relative to the top plate 16 when positioned in a first or second convertible state of attachment. Referring to FIG. 9 and FIG. 2 together, FIG. 9 shows the swivel mechanism 62 in a state in which the swivel mechanism 62 has been rotated in a horizontal plane to bring the swivel plate 60 into a skewed position relative to the top plate 16, thereby angularly aligning a longitudinal axis S of the swivel plate 60 with a longitudinal axis T of the tilt table portion 54 and top plate 16. The longitudinal axis T is generally perpendicular to the gunwale 23 passing under the top plate 16, whereas the longitudinal axis S of the swivel plate 60 is generally parallel with the direction of travel of the boat. In contrast, FIG. 2 shows the tilt bracket 50 without the presence of the swivel plate 60 to clearly illustrate a plurality of associated apertures 73 defined in the top plate 16 of the tilt bracket 50 which permit mounting of the trolling motor directly to the tilt bracket 50. This permits the longitudinal axis T to be fixed in the direction perpendicular to the mounting support, whether mounted to a transom or gunwale.

The alternative function of the apertures 72 of the swivel plate 60 is to permit locking of the swivel plate 60 along the longitudinal axis S, by means of a removable locking pin 80. The locking pin 80 is dimensioned to closely pass through the pair of apertures comprising apertures 72 and 73 of the swivel plate 60 and top plate 16 of the tilt bracket 50, respectively, which are brought into registry. Each of the apertures 73 of the top plate 16 are positioned in registry with each of a different one of the plurality of apertures 72 defined in the swivel plate 60 when the top plate 16 and the swivel plate are aligned along the same axis, namely longitudinal axis T; when axes S and T are angularly aligned, different holes are so aligned with one another. Therefore, each aperture 72,73 should be equidistant along a radius from the swivel mechanism 62 and coplanar with its respective plate 60 or 16. Any predetermined number of apertures 73 may be chosen, including a large number thereby defining an arc of apertures (not shown) spaced at various predetermined angles from the longitudinal axis T, and the number is not limited to four as shown.

The locking pin 80 (FIGS. 9 and 6) is preferably a spring-loaded pin, well known in the art, which when inserted through both apertures retains itself within the apertures by mechanical forces. For example, a key hole aperture may be provided wherein the locking pin includes a terminal key or tooth which engages with a first surface of the top plate or swivel plate after passing through the key hole aperture. A spring biasing means exerts pressure upon an opposing surface to maintain engagement of the tooth against the first surface. However, any appropriate locking pin may be used, including devices having ball detents capable of passing through circular apertures, a bolt and nut assembly, or the like.

Figure 3:
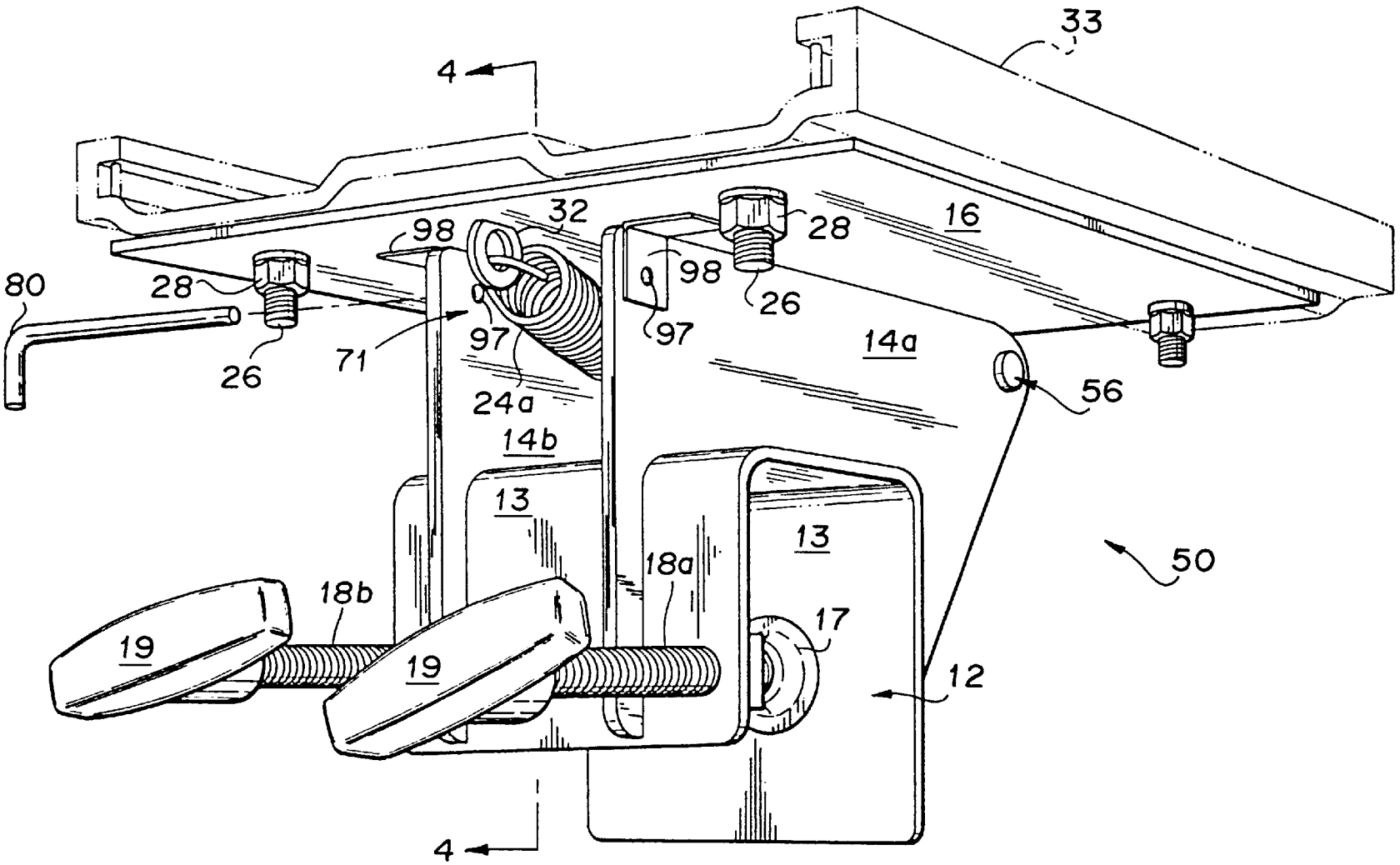
FIG. 3 is a right side perspective view of the tilt bracket of the mounting bracket assembly.

Referring now to FIG. 2 and FIG. 3 together, an alternative function for the apertures 73 of top plate 16 of the tilt bracket 50 is also apparent. Many trolling motors include a motor mounting bracket 33 defining a plurality of holes (not shown). This bracket 33 can be adapted for use with the top plate 16, as well as with the swivel plate 60 in combination with the top plate 16, by bringing the holes of the mounting bracket 33 into registry with apertures 73 or 72, respectively, and securing the assembly into a rigid configuration by an attachment means. As shown in FIG. 3, the attachment means is a threaded bolt 26 passed through the hole of the motor mounting bracket 33 and secured below the top plate 16 with a matingly threaded nut 28. As previously noted, FIG. 7 illustrates the second convertible state of attachment, wherein the swivel plate 60 is in a stored condition. The swivel plate 60 is sandwiched between the motor mounting plate 33 (usually provided with a trolling motor 35B) and the top plate 16. The second convertible state may be rigidly fixed by the attachment means, e.g. bolt 26.

As alluded to earlier, the swivel mechanism 62 rotatably attaches the swivel plate 60 to the top plate 16, which permits skewed positions with a multitude of advantageous uses. As described, a first advantage of the assembly includes mounting the tilt bracket 50 to a bow gunwale 23, whereby the swivel plate can be angularly and fixedly positioned in the axis of the direction of travel of the boat, a more familiar and comfortable position to most boaters ordinarily using a transom mount. Also, the tilt table portion 54 is thus made operable by providing the aforementioned advantageous clearance from the boat hull. Each of these advantages are directed towards the use of motor in its normal operational mode.

Figure 10:
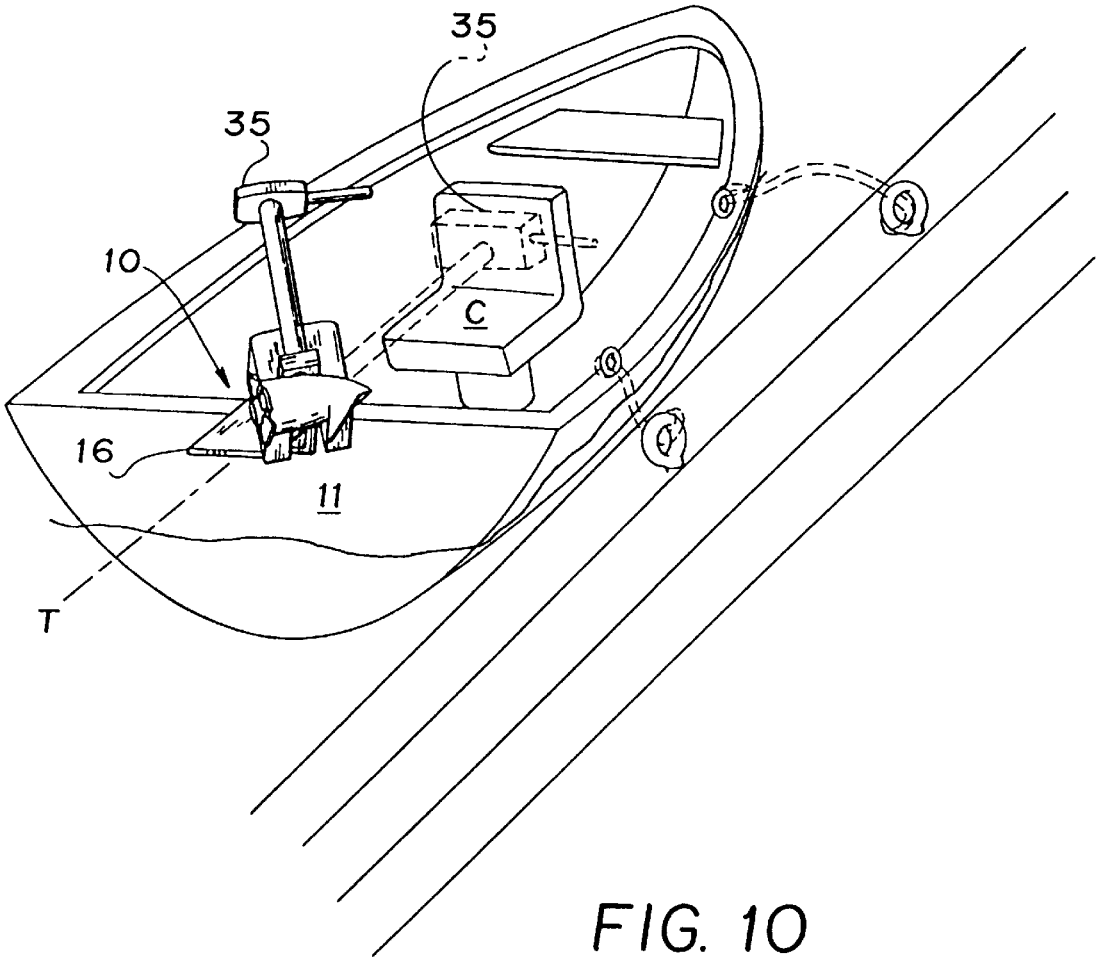
FIG. 10 is an environmental, top perspective view of the preferred embodiment of the mounting bracket assembly representing an advantageous use by rotating the swivel plate while the trolling motor is in a stored mode.

An equally important advantage, however, is provided while the trolling motor is in its stored mode. FIG. 10 illustrates the use of the swivel plate of the present invention 10 during storage of the trolling motor 35. Ordinarily, a trolling motor 35 is incapable of rotating horizontally in its stored mode, and therefore, is only capable of being brought into a horizontal, resting position (as shown by both phantom and solid lines) aligned along a fixed axis transverse to its mounting support. As shown in FIG. 10, the mounting support is a transom 11 and the fixed axis is longitudinal axis T. Therefore, without benefit of the present invention 10, the trolling motor 35 would immovably rest along longitudinal axis T, thereby impeding use of certain features of the boat, particularly the chair C, as shown in FIG. 10. By taking advantage of the swivel mechanism and swivel plate, the motor 35 may be momentarily moved out of the way during loading, embarking or disembarking, or other necessary preparation of the boat.

In particular, depending on the fixed axis T relative to a mounting support, the use of other features may be impaired in boats of various designs. As an alternative example, in a V-shaped bow, a typical bow mounted trolling motor would likely extend beyond the opposing gunwale across the entire beam of the boat, placing the propeller outboard of the gunwale, thus preventing safe trailering of the boat. Safe trailering would thus require dismantling of the motor from its mounting support. In contrast, use of the present invention 10 provides the angular rotation necessary to bring the propeller inboard of the gunwales, at which position the swivel plate 60 can be locked by the locking pin 80.

Figure 4:
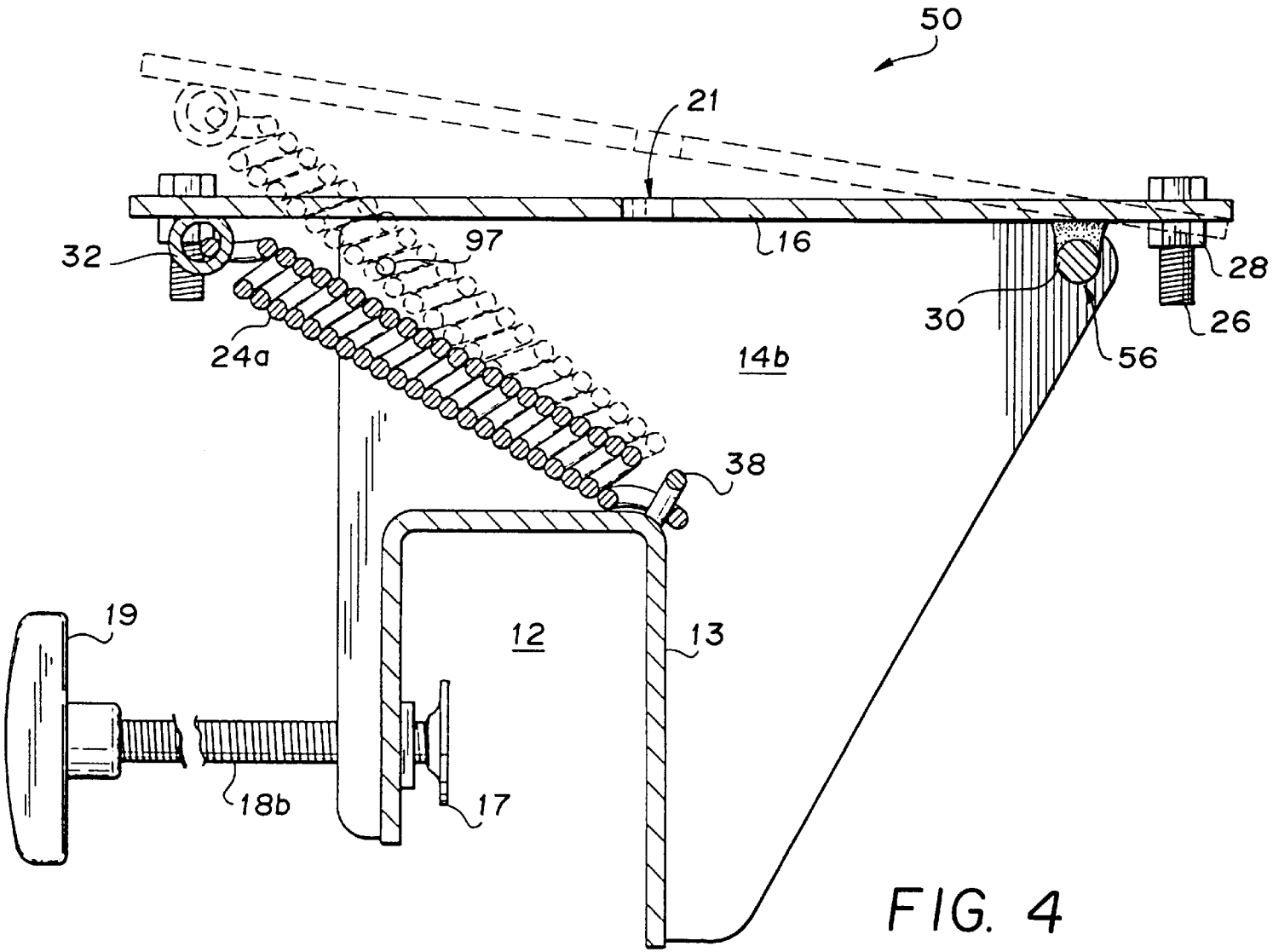
FIG. 4 is a right side sectional view of the tilt bracket drawn along lines 4—4 of FIG. 3, showing the tilt bracket in an operative position in phantom lines.
Figure 5:
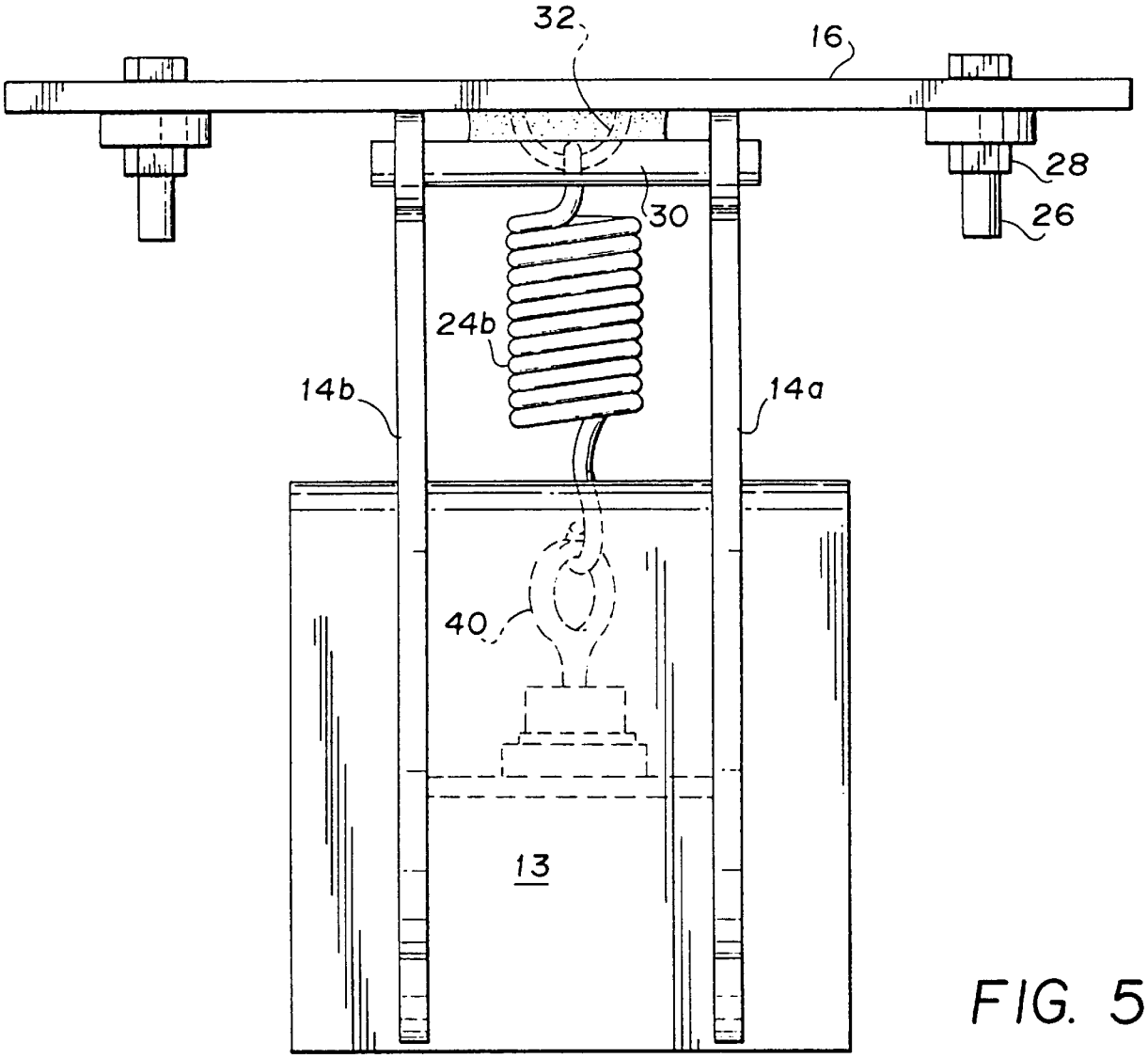
FIG. 5 is a rear elevational view of a second embodiment of the tilt bracket showing a vertically disposed spring.

The specific features of the present invention are now discussed below with respect to the energy-absorbing function of the tilt-mechanism alone. FIGS. 3 and 4 show a first embodiment of the tilt bracket 50 utilizing an angularly disposed spring 24A as energy-absorbing means; FIG. 5 shows a second embodiment of the tilt bracket 50 using a vertically disposed spring 24B as energy-absorbing means;

and FIG. 6 shows a third embodiment of the tilt bracket 50 using a pneumatic or hydraulic shock-absorber 22 as energy-absorbing means.

The tilt bracket 50 comprises the clamp portion 52, dimensioned and configured to rest on a bow gunwale 13, and the tilt table portion 54 pivotally attached to the clamp portion 52 by the pivot mechanism 56. The clamp portion 52 comprises two parallel side plates 14*a*,14*b* defining a U-shaped recess 12 through which the mounting support (i.e. gunwale or transom) can pass. A U-shaped channel wall 13 spans from a right side plate 14*a* to a left side plate 14*b* and is joined to the side plates within the recess 12. Each side plate 14 is affixed to U-shaped channel wall 13 and extends upwardly therefrom.

The clamp portion 52 includes conventional clamping means for securing the tilt bracket 50 to the bow gunwale or transom. In the preferred embodiment, the clamping means include a right threaded shaft 18*a* and a left threaded shaft 18*b* having opposing termini. Each shaft closely passes through the channel wall 13, which is provided with a matingly threaded passage for each shaft 18*a*,18*b*. The shafts may therefore be selectively rotated inwardly and outwardly to secure the tilt bracket 50 to a mounting support of varying thickness.

To prevent marring of the surface of a mounting support, the terminus of each threaded shaft disposed within the channel defined by the U-shaped channel wall 13 is provided with a pressure plate 17 for distributing clamping forces over the mounting support of the boat. In the alternative or addition to the pressure plate 17 (as seen in FIG. 2), a prismatic U-shaped guard plate 25, preformed of a pliable metal sheet material, such as aluminum, may be laid over the mounting support for added protection of the mounting support surface of the boat. On the opposing terminus, a knob 19 is attached to conveniently rotate each threaded shaft 18*a*,18*b*.

The tilt bracket 50 further includes a tilt table portion 54 including a top plate 16, having an outboard end 24 and an inboard end 26, and an energy-absorbing assembly 71 having a first end 77 attached to the underside of the inboard end of the top plate 16 and a second end to the clamp portion 52, preferably attached to the channel wall 13. The top plate 16 is pivotally attached to span the tops of the two side plates 14*a*,14*b* by the pivot mechanism 56. The pivot mechanism 56 may be a rod 30 attached to the underside of outboard end 24 of the top plate 16, serving as a trunnion passing through each of the side plates 14*a*,14*b*. The pivot mechanism 56 is positioned diametrically opposite the first end 77 of the energy-absorbing mechanism 71. This arrangement permits the pivot mechanism 56 to be mounted outboard of the gunwale 23 about which the top plate 16 pivots.

The energy-absorbing mechanism 71 is the feature which varies among the first, second and third embodiments. In FIG. 3 and 4, a spring 24A is attached at its first end to top plate 16 via a ring 32 welded to the underside of the top plate 16. The opposing second end of the spring 24A is attached diagonally below top plate 16 to a second ring 38, generally centered under pivot hole 21 and welded to the U-shaped channel wall 13. Thus, when an operably mounted motor strikes an underwater object as previously described, the spring 24 is caused to stretch as the top plate 16 pivots about pivot mechanism 56, as suggested by the phantom lines of FIG. 4. The elasticity of spring 24A will force top plate 16 back to its original position atop side plates 14*a*,14*b* after the object is free of the motor. The spring tension and wire size may be varied to raise or lower the threshold of force of the impact necessary before the pivot mechanism is allowed to rotate, as well as to alter the amount of return force necessary to return the top plate back to a horizontal attitude.

Although the spring 24A of the preferred embodiment is shown diagonally disposed, a spring 24B of the second embodiment of FIG. 5 is disposed vertically, depending at its first end from a similar ring 32 attached to the top plate 16, and attached at its second end to a second ring assembly 40 affixed between the side plates 14*a*,14*b*. By having spring 40 disposed in a vertical relationship, the amount of vibrational dampening in response to the motor striking an underwater object is increased, even if a spring 24B is used having the same spring constant k as the spring 24A of the preferred embodiment.

In FIG. 6 of the drawings, a right side sectional view illustrates a shock absorber 22 used to dampen forces exerted on the motor 35 when it strikes an underwater object. The advantage that a shock absorber confers over a spring is that either one of two types of shock absorber may be used, either a dampening type, (requiring diametrically inward forces to compress the shock-absorber and traditionally referred to as the "shock-absorber" on motor vehicles), or a gas-filled strut type which requires evacuation of internal gases when diametrically opposing forces cause the strut to expand or contract, thus providing expansion forces or dampening forces.

The preferred embodiment employs a strut type which is positioned and calibrated with the tilt table portion 54 in a resting state to require only a slight force of underwater impact to cause expansion of the shock absorber and remove the motor and propeller out of harm's way by rotating the tilt table portion 54 about the pivot mechanism 56 with a minimum of force. In high-impact situations, the gas strut type can compress the internal gas to dampen the impact forces despite inability to rapidly evacuate internal gases. Conversely, the dampening type may be used to dampen impact forces without returning the tilt-table portion 54 to its original position. With either type, the mounting bracket 10 in combination with the swivel plate 60 is capable of removing one of a plurality of motor types from continued high-impact forces encountered at any position about the boat.

As shown in FIG. 3 and FIG. 4, the tilt bracket is also provided with a means for disabling the ability of the tilt-table portion to pivot. One such means is a locking pin 80 which passes through an aperture 97 defined by one of side plate 14*a* or 14*b*, or both, and through a tang 98 depending from the underside of the top plate 16. Insertion of the locking pin 80 through both the tang 98 and the side plate 14*a* or 14*b* disables the pivotal movement. The pin 80 may be attached by a tether (not shown) having an end permanently attached to the tilt-table 54 in order to prevent the pin's loss when not engaged in the apertures 97.

This locking pin feature may be desirable during certain emergency circumstances, such as if the spring or shock absorber fails, thereby leaving the tilt-table subject to undampened resistive forces, such as incurred during bouncing of the boat over choppy water. Moreover, during higher speed cruising, the tilt-table portion may be subject to ordinary forces, again perhaps while passing through chop, which overcome the tension or dampening threshold set by the spring or shock absorber for underwater impact. Thus, the boater has the option of inserting the pin and eliminating undesired bounce in situations where a low risk of underwater impact is present.

Figures 11A, 11B:
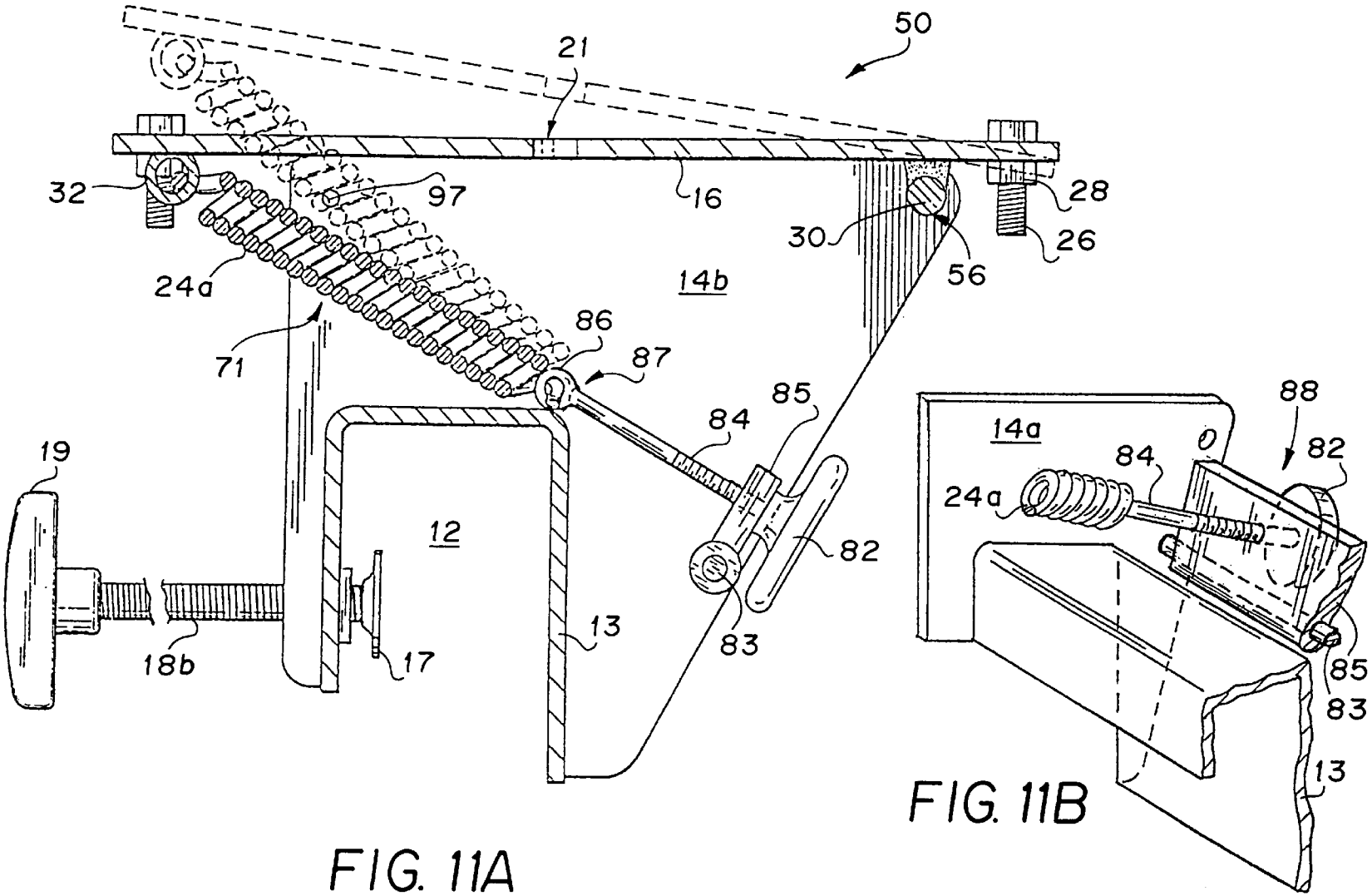
FIG. 11A is a side view of a spring tension adjustment mechanism of the tilt bracket according to the present invention.
FIG. 11B is a perspective view of the spring tension adjusting assembly of the spring tension adjustment mechanism according to the present invention.

FIG. 11A shows an another energy absorbing mechanism 71 of the present invention. In FIG. 11A, the spring 24A is attached to a ring 86 located at the proximal end 87 of a threaded shaft 84 that is used to elongate or shorten the spring 24A. Although this embodiment shows the spring 24A attached to the threaded shaft 84 via a ring 86, any suitable coupling means would suffice. The tension in the spring 24A is either increased or decreased using a tension adjusting wheel 82. Adjusting the tension in the spring 24A makes it possible to increase or decrease the vibrational dampening capability of the energy absorbing mechanism 71. When there is minimal risk of the motor 35 striking an underwater object 0, then the tension in the spring 24A can be increased using the tension adjusting wheel 82 and when there is a high risk of the motor 35 striking an underwater object 0, for example, when the boat is near the shore, the tension in the spring 24A can be decreased which maximizes the energy absorbing capabilities of the present invention.

FIG. 11B shows a perspective view of the pivot pin assembly 88 of the alternate embodiment depicted in FIG. 11A. FIG. 11B depicts the structural and functional relationships between the threaded shaft 84, the tension adjusting wheel 82, and the pivot pin 83. The pivot pin assembly 88 includes a plate 85 substantially spanning between side plates 14*a*,14*b* and mounted by a pivot pin 83, each end attached to a side plate 14*a*,14*b*. The threaded shaft 84 is passed through a matingly threaded hole in plate 85. The tension of the spring 24A is adjusted to the appropriate tension using the tension adjusting wheel 82 by advancing or withdrawing shaft 84 through the plate 85.

Figure 12B:
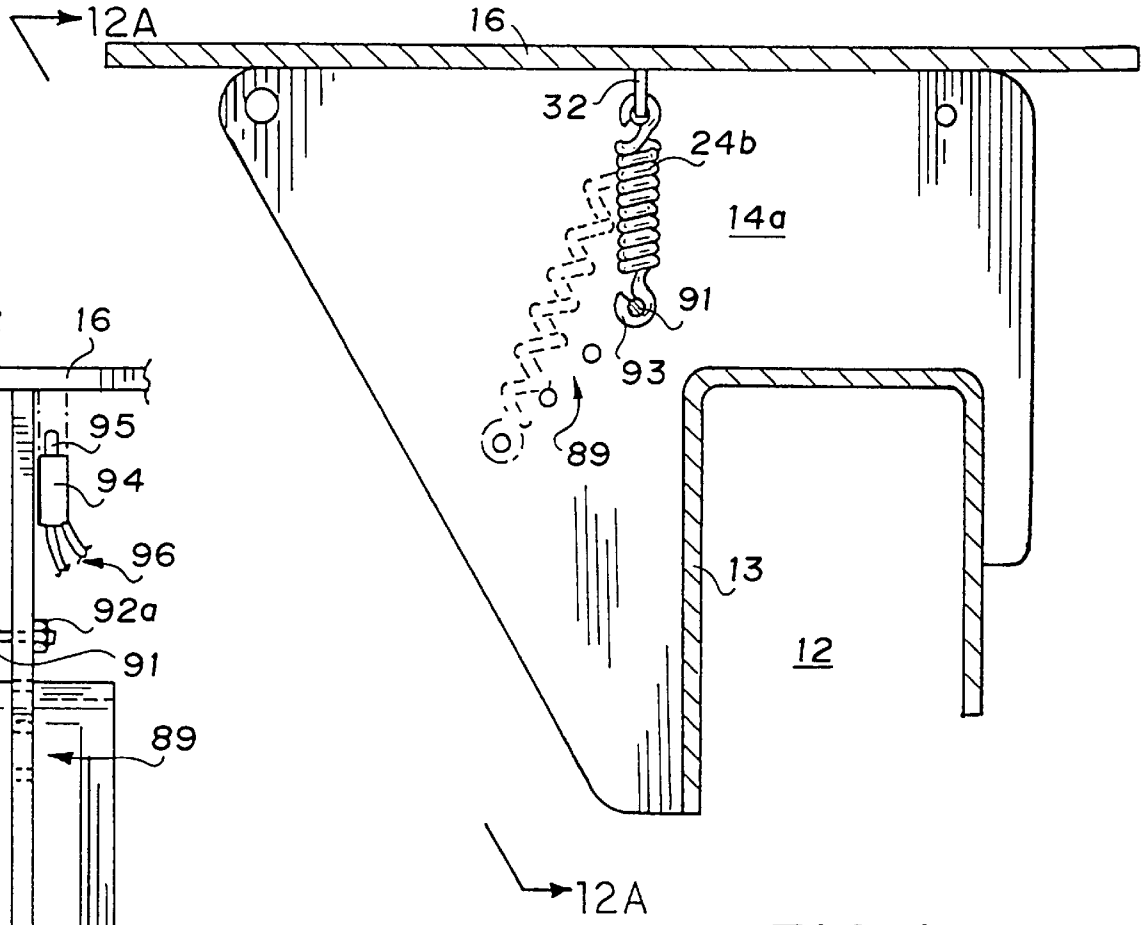
FIG. 12B is a side view of the alternate embodiment of the spring tension adjustment mechanism according to the present invention.
Figure 12A:
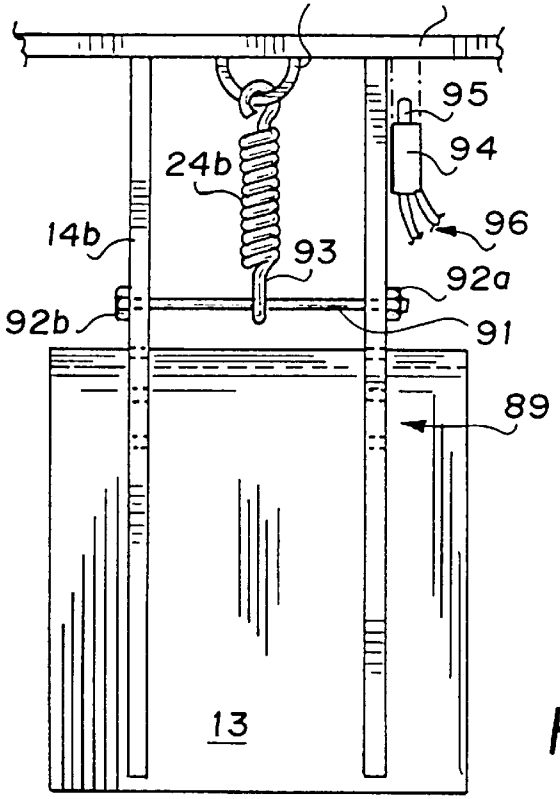
FIG. 12A is a rear view of an alternate embodiment of the spring tension adjustment mechanism according to the present invention.

FIG. 12A depicts an alternate embodiment whereby the spring 24B is initially vertically disposed but becomes diagonally disposed as the tension in the spring 24B is increased by gradually varying the location of a tension adjusting bar 91. The tension adjusting bar 91 passes through parallel openings 89 in the side plates (14*a*,14*b*) and is held in place by a pair of metal collars (92*a*,92*b*). The tension adjusting bar 91 may be covered with a protective coating or sheath. The tension of the spring 24B is varied by passing the bar 91 through the loop 93 of the free end of the spring 24B, then placing the bar 91 into a specific pair of parallel openings 89 in the side plates (14*a*,14*b*). As shown in FIG. 12B, the paired openings 89 are disposed diagonally along the side plates (14*a*,14*b*).

Thus, by placing the tension adjusting bar 91 in the various openings 89 along the side plates (14*a*,14*b*), the resting tension of the spring 24B can be varied. When the tension adjusting bar 91 is in the most anterior location, the spring 24B is vertically disposed and has minimal resting tension, while when the bar 91 is in the most posterior location, the spring 24B is diagonally disposed and has maximal resting tension.

In a preferred embodiment, the present invention also contains an ON/OFF switch 94 as shown in FIG. 12A as a kill-switch for interrupting the operation of the motor when the tilt table 54 has been pivoted, e.g. during impact. The ON/OFF button 95 of the switch 94 is depressed into the ON position by the weight of the top plate 16. Electrical leads 96 run from a power source (not shown) through the switch 94 to the motor 35. When the motor 35 strikes an underwater object 0, the motor 35 recoils and causes the top plate 16 to move upwards which releases the ON/OFF button 95 of the ON/OFF switch which interrupts power to the motor 35 thereby shutting the motor 35 off. For the purpose of clarity of illustration in FIG. 12A, the switch 94 is shown exploded from its affixed position and not in contact with the top plate 16.

Figure 13:
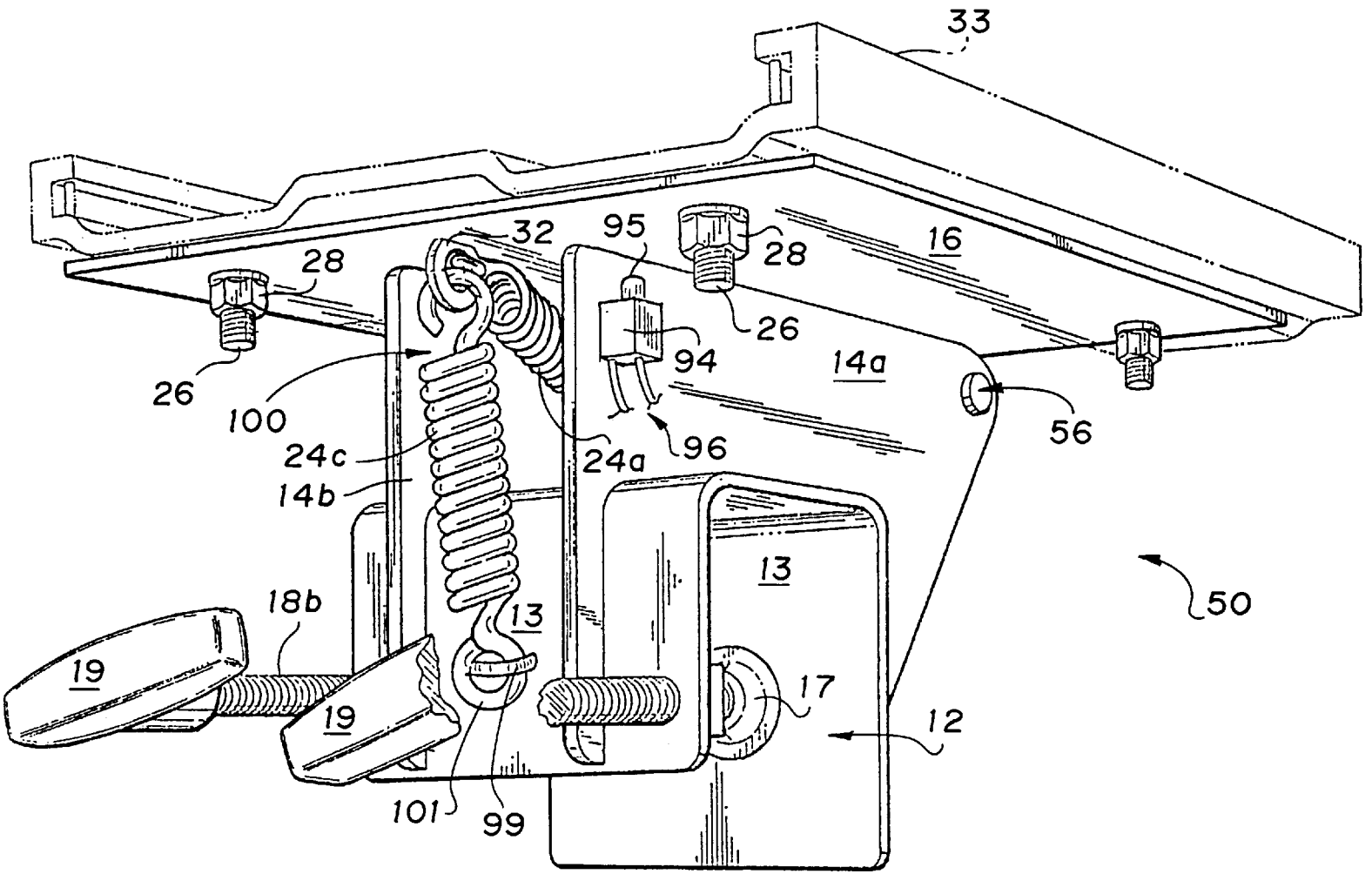
FIG. 13 is a perspective view of an alternate embodiment including an additional tension bearing spring of the tilt bracket.

FIG. 13 depicts an embodiment that employs both a vertically disposed spring 24C and a diagonally disposed spring 24A in its energy-absorbing mechanism 100. The vertically disposed spring 24C and the diagonally disposed spring 24A are both attached to the ring 32 welded to the underside of the top plate 16. The other end 101 of the vertically disposed spring 24C is attached to a second ring 99 welded to the front surface of the tilt bracket 50. This dual spring (24A,24C) arrangement increases the vibrational dampening ability of the energy-absorbing mechanism 100. This increased vibration dampening capability is important when heavier motors are involved. The ON/OFF switch 94 may also be attached to either side of the tilt bracket 50 and is a safety feature that is used to turn the trolling motor 35 off when the motor 35 tilts due to an obstruction 0 and which returns the motor 35 to operation after the obstruction 0 has been cleared.

Figure 14:
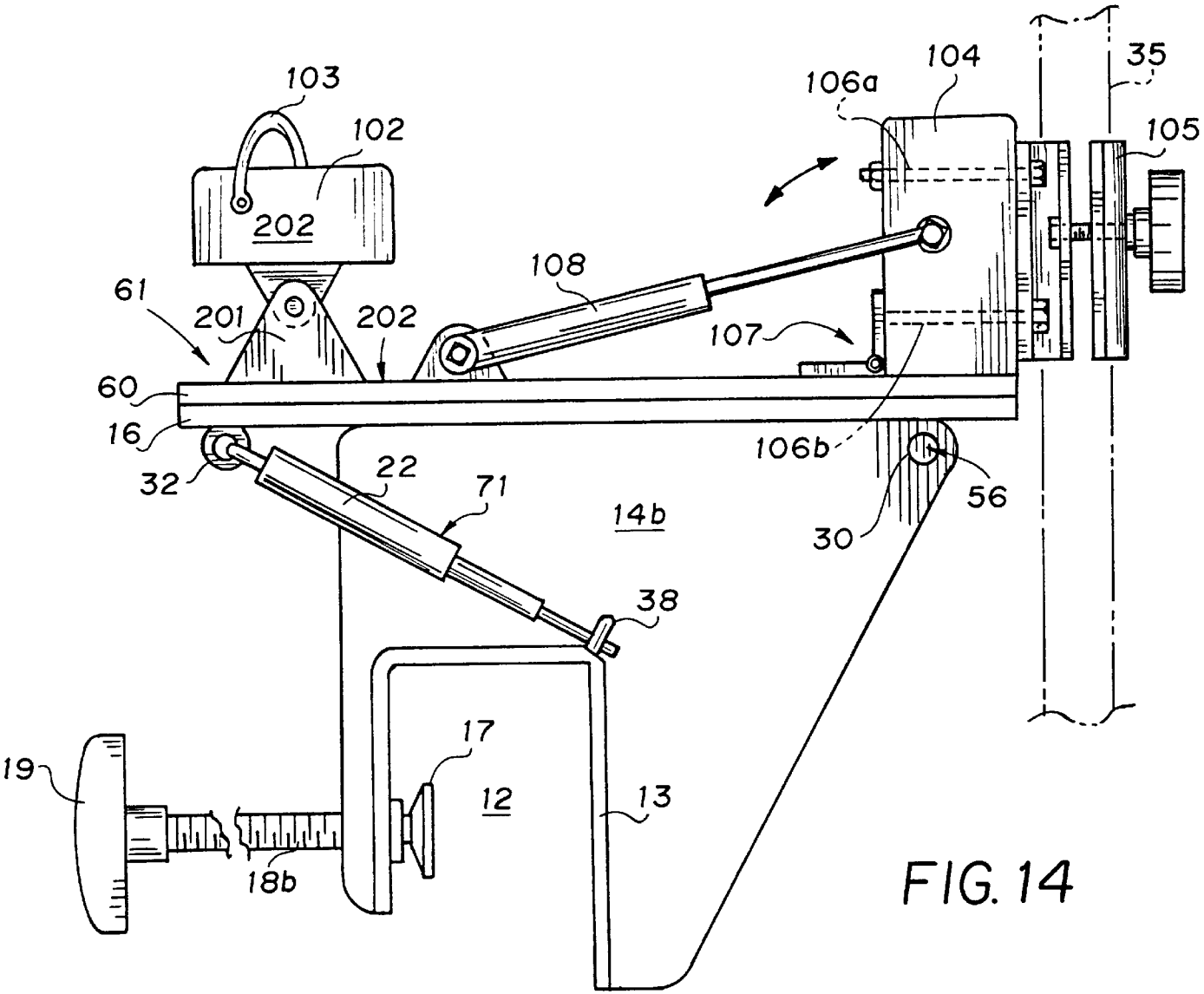
FIG. 14 is a side view of an alternate embodiment of the tilt bracket showing a trolling motor rest, a quick-release coupler for mounting the shaft of a trolling motor, and a surface shock absorber.

FIG. 14 depicts yet another embodiment that allows the quick release or attachment of a trolling motor to its steering shaft, as well as, provides a rest 102 with a hold down strap 103 for securing the trolling motor 35 when the motor 35 is no longer in use. This embodiment uses a single rectangular piece 104 (such as a metal tube) as cross bar (64 in prior FIGS.), mounted near the rear of the swivel plate 60, to which is attached a quick release coupler 105 by two metal bolts (106*a*,106*b*). Alternatively, two smaller rectangular tubes of metal, with one piece mounted on top of the other can be used in place of the single larger rectangular piece 104.

A hinge assembly 107 is provided between the metal rectangular piece 104 and the swivel plate 60 to allow the rectangular piece 104 (and bolted quick release coupler 105 with attached trolling motor 35) to rotate about the hinge 107. This allows the trolling motor 35 to be placed in a vertical position in its operational mode for use in propelling a boat, or, be placed in a horizontal position for storage when not in use. Moreover, in conjunction with the hydraulic cylinder 108 (or other energy-absorbing means) as described following, the hinge 107 permits rotation of the motor from a vertical plane while in the operational mode in the event of impact with an underwater obstacle while the boat is travelling in a reverse direction. As can be easily understood seen from FIG. 14, the hinge 107 angularly opens and pivots in the opposite direction from that of the tilt bracket 50, thus allowing bi-directional angular movement of the trolling motor, i.e. rearward when the boat is moving forward, and forward when the boat is moving rearward.

As alluded to above, hydraulic cylinder 108 is used to prevent hinge 107 from unnecessarily pivoting and to maintain the piece 104 with the trolling motor 35 attached in a vertical position. A spring or a gas cylinder, depending on the attachment configuration, could be used instead of a hydraulic cylinder 108. As shown, the cylinder 108 is rotatably attached at its ends to the top surface 202 of the swivel plate 60 and the ends of piece 104 to permit piece 104 to hinge.

The rest 102 is located at the front 61 of the swivel plate 60. The rest 102 comprises a base 201 depending upwardly from the top surface 202 of the swivel plate, to which base 201 a head 202 is pivotally attached. The head 202 includes hold down strap 103 for securing the trolling motor 35 between strap 103 and head 202 when not in use. The pivotal rest 102 permits the head 202 to accommodate the shaft of various trolling motors or of a trolling motor at various positions.

Figure 15:
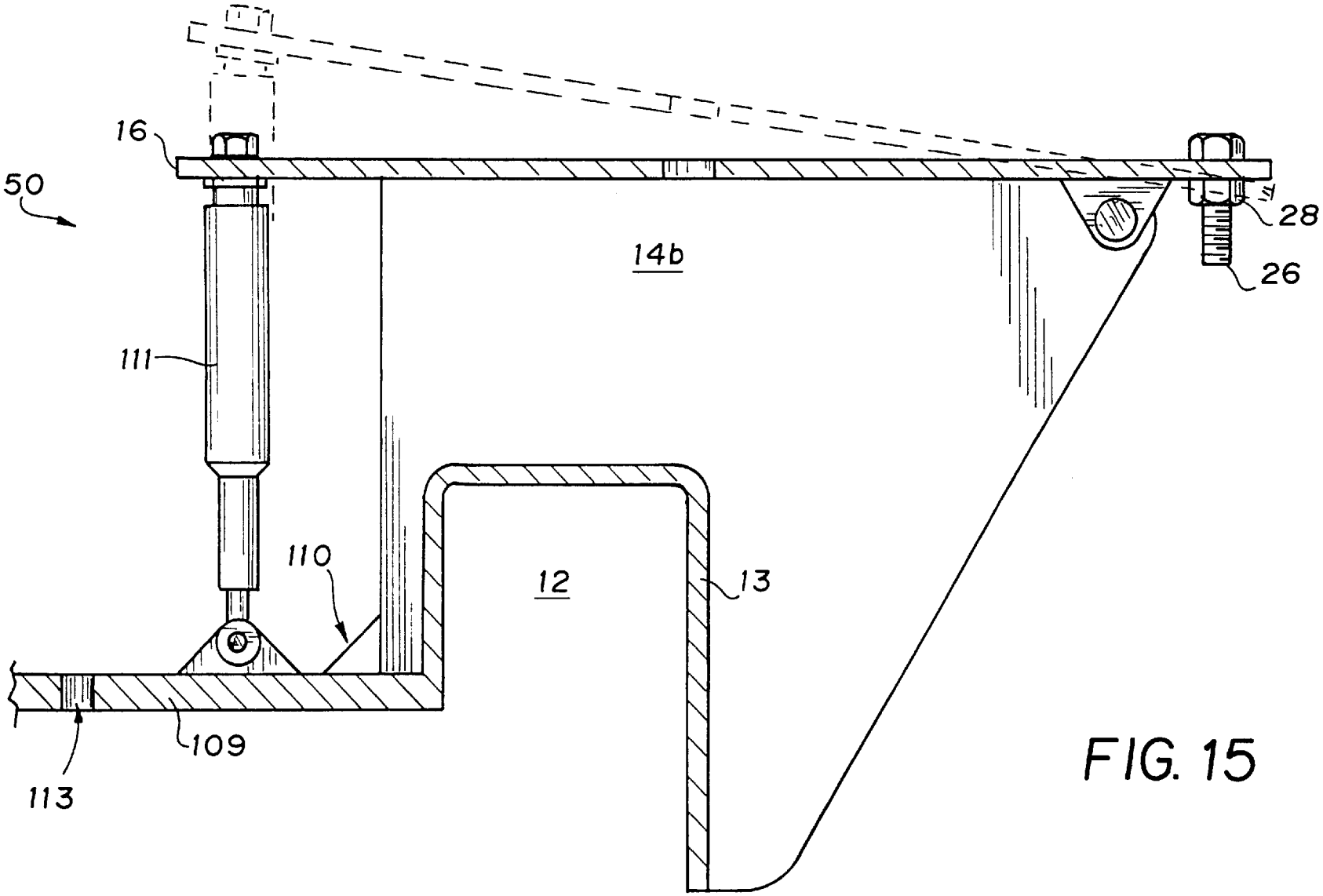
FIG. 15 is a side, sectional view an alternate embodiment of the tilt bracket showing a vertically mounted shock-absorber, intended for use with larger trolling motors.

A heavy duty version of the tilt bracket 50 is shown in FIG. 15. This embodiment is designed to handle large motors with a lot of torque that could dislodge a tilt bracket 50 secured to a boat by clamps. In the embodiment depicted in FIG. 15, the tilt bracket 50 has an integrally formed heavy metal plate 109 that is bolted to the boat. This integrally formed heavy metal plate 109 is an extension of the U-shaped channel wall 13. The adherence of the side plates (14*a*,14*b*) to the heavy metal plate 109 is strengthened by a metal weld or brace 110. A heavy duty shock absorber 111 that is mounted on the heavy metal plate 109 is secured to the front portion of the top plate 16 of the tilt bracket 50 and functions as the energy-absorbing mechanism. The heavy duty shock absorber 111 is vertically disposed between the heavy metal plate 109 and the top plate 16 of the tilt bracket 50.

To assist in the mounting of the heavy duty bracket 50 to various boats having widened gunwales or the like, an aperture 113 is provided in plate 109 for receiving a stud or other vertical axle (not shown) mounted to the boat. The single rotational axis provided by the stud so mounted permits the plate 109 to be angularly adjusted about aperture 113 as necessary to accommodate the bracket to the mounting surface.

As described above with respect to the various embodiments, the vibration dampening mechanism of the present invention minimizes or eliminates damage to a trolling motor resulting from the impact of the trolling motor with an underwater object. Numerous embodiments of the present invention have been described to demonstrate the enormous versatility of the present invention which allows for many possible modifications and adaptations of the present invention, all of which would be within the scope of the invention.

The preferred embodiments of the present invention disclosed herein are intended to be illustrative only and are not intended to limit the scope of the invention. It should be understood by those skilled in the art that various modifications and adaptations of the present invention as well as alternate embodiments of the present invention may be contemplated. It is to be understood that the present invention is not limited to the embodiments described above, but encompasses any and all embodiments within the scope of the following claims.

I claim:

1. A convertible mounting bracket assembly comprising:
two separable main components including
a tilt bracket comprising
a clamp portion for securing said assembly to a mounting support,
a top plate;
a pivot mechanism attached to said clamp portion and said top plate for angularly rotating said top plate about said pivot mechanism;
an energy-absorbing assembly having a first end operably attached to said top plate and a second end operably attached to the clamp portion;
a swivel plate including a cross bar perpendicularly and transversely attached to the swivel plate; and,
a swivel mechanism for rotating the swivel plate and removably attaching said swivel plate coplanar to said top plate, said swivel mechanism including said top plate and said swivel plate each defining a hole in registry with the other and centrally positioned in said top plate and said swivel plate, and a bolt secured therein.

2. The convertible mounting bracket assembly according to claim 1 wherein said energy-absorbing assembly is a member selected from the group comprising a spring, a hydraulic shock-absorber, a pneumatic shock-absorber and a gas-filled strut.

3. The convertible mounting bracket assembly according to claim 1 further comprising locking means for fixing the relative position of said swivel plate to said top plate.

4. The convertible mounting bracket assembly according to claim 3 wherein said locking means comprises said top plate defining a plurality apertures, said swivel plate defining a plurality of apertures positioned to be brought into registry with each one of said plurality of apertures of said top plate, and a locking pin for passing through a pair of apertures brought into registry.

5. The convertible mounting bracket assembly according to claim 4 wherein said locking pin include quick-release means for retaining said locking pin in said pair of apertures.

6. The convertible mounting bracket assembly according to claim 1 wherein said swivel plate is positioned relative to said top plate to define an overhanging portion extending beyond said top plate proximate said pivot mechanism, said cross bar being attached to said overhanging portion.

7. The convertible mounting bracket assembly according to claim 1 wherein said energy-absorbing assembly has a second member having a first end operably attached to said top plate and a second end operably attached to said clamp portion.

8. The convertible mounting bracket assembly according to claim 7 wherein said second member of said energy-absorbing assembly is a spring.

9. A mounting bracket assembly comprising:
a tilt bracket comprising
a clamp portion for securing said assembly to a mounting support,
a top plate;
a pivot mechanism attached to said clamp portion and said top plate for angularly rotating said top plate about said pivot mechanism;
an energy-absorbing assembly having a first end operably attached to said top plate and a second end operably attached to the clamp portion, said energy-absorbing assembly having tension adjusting means;
a swivel plate; and,
a swivel mechanism for rotating the swivel plate and attaching said swivel plate coplanar to said top plate.

10. The mounting bracket assembly according to claim 9 wherein said second end of said energy-absorbing assembly is attached to a tension adjusting mechanism.

11. The mounting bracket assembly according to claim 9 wherein said swivel plate includes a pivotally mounted coupling mechanism for removably attaching a trolling motor.

12. The mounting bracket assembly according to claim 11 said swivel plate further including a motor rest having a strap.

13. The mounting bracket assembly according to claim 12 wherein said rest includes a pivot.

14. The mounting bracket assembly according to claim 9 wherein said clamp portion comprises a metal plate and said second end of said energy-absorbing assembly is operably attached to said heavy metal plate.

15. The mounting bracket assembly according to claim 9 further comprising a means for temporarily and reversibly disabling the ability of the tilt-table portion to pivot.

16. The mounting bracket assembly according to claim 9 further comprising a kill-switch for temporarily disabling the operation of a trolling motor, operably wired to interrupt the operation when said tilt-table pivoted.

17. The mounting bracket assembly according to claim 16 wherein said kill-switch is affixed to said clamp portion and positioned proximate said top plate and operable between and open and closed position relative to the pivotal angular position of said top plate.

* * * * *